United States Patent [19]

Bakermans et al.

[11] 4,290,179

[45] Sep. 22, 1981

[54] CABLE HARNESS ASSEMBLY MACHINE

[75] Inventors: Johannes C. W. Bakermans; Richard A. Neiman, both of Harrisburg, Pa.

[73] Assignee: AMP Incorporated, Harrisburg, Pa.

[21] Appl. No.: 86,927

[22] Filed: Oct. 22, 1979

[51] Int. Cl.[3] ..... B25B 11/02; H01R 43/04

[52] U.S. Cl. ..... 29/33 M; 29/566.2; 29/743; 29/749; 51/235; 144/278 A; 248/363; 269/21; 279/3

[58] Field of Search ..... 29/566.2, 33 M, 760, 29/743, 749; 269/21; 248/363; 279/3; 144/278 A; 51/235

[56] References Cited

U.S. PATENT DOCUMENTS

| | | | |
|---|---|---|---|
| 1,851,028 | 3/1932 | Worrall . | |
| 2,317,348 | 4/1943 | Wekeman . | |
| 2,549,254 | 4/1951 | Smyth . | |
| 3,084,640 | 4/1963 | Hayes et al. . | |
| 3,156,462 | 11/1964 | Weaver | 269/21 |
| 3,233,887 | 2/1966 | Dunham | 269/21 |
| 3,453,957 | 7/1969 | Hamilton | 248/363 X |
| 3,553,836 | 1/1971 | Cootes . | |
| 3,608,909 | 9/1971 | Rabinow . | |
| 3,774,284 | 11/1973 | Cootes . | |
| 3,797,797 | 3/1974 | Keller . | |
| 4,021,095 | 5/1977 | Kinkaid et al. . | |
| 4,131,267 | 12/1978 | Ono et al. . | |

*Primary Examiner*—Z. R. Bilinsky
*Attorney, Agent, or Firm*—Russell J. Egan

[57] ABSTRACT

An improved machine is disclosed for forming cable harnesses by simultaneously terminating all conductors at one or both ends of a cable formed of a plurality of flat conductors embedded within a web of insulating material. The subject machine incorporates a cable positioning and hold down mechanism which both accurately positions the end of the cable to be terminated at a proper location relative to the terminals, which are subsequently gang applied thereto, as well as firmly holds the cable in position during termination. The subject hold down mechanism is adjustable for various widths of cable and the dual terminating machine is adjustable for cables of varying lengths.

14 Claims, 12 Drawing Figures

CABLE HARNESS ASSEMBLY MACHINE

BACKGROUND OF THE INVENTION

1. The Field of The Invention

The present invention relates to a cable harness assembly machine and in particular to a cable hold down and positioning device acting on multi-conductor flat flexible cable fed into the assembly machine.

2. The Prior Art

There are many well known cable harness assembly machines which are capable of sequentially applying a plurality of terminals to one end of a pre-formed cable. Such a machine is shown in U.S. Pat. No. 3,774,284. There are some machines that are capable of applying terminals intermediate the ends of the cable to form what is known as a daisy chain. U.S. Pat. No. 3,553,836 shows such a machine.

There is a number of problems associated with these known machines amongst which are difficulties in handling the cable prior to termination as well as difficulties involved in removing the cable from the machine after termination without damaging or misaligning the newly applied terminals. Also, these machines are relatively slow in that they sequentially apply terminals and to only one end of the cable at a time.

SUMMARY OF THE INVENTION

The present invention is intended to overcome the above discussed difficulties of the prior art. The subject machine has a press assembly including a front loading work station with at least one multi-terminal applicator positioned beneath the press. A terminal supply means feeds a continuous supply of terminals to each respective applicator. A cable hold down apparatus is movably mounted at the work station and adapted to secure a cable and hold it in a properly aligned position relative to the applicator while the terminals are applied to the cable end. The cable hold down is so arranged that after the cable has been terminated, the completed harness assembly is readily extracted from the machine without damage to any portion of the cable or the attached terminals.

It is therefore an object of the present invention to produce a cable harness assembly machine having an improved cable hold down and alignment means.

It is another object of the present invention to produce a cable harness assembly machine which can be used to apply multiple terminals to one or both ends of a flat flexible cable in a single operation.

It is still another object of the present invention to produce an improved cable hold down apparatus for a cable harness assembly machine in which the cable will be firmly secured in the correct position during the terminating operation and yet will be readily released upon completion of the termination.

It is a further object of the present invention to produce a cable harness assembly machine which is readily adjustable for various widths and lengths of cable.

It is a still further object of the present invention to produce a cable harness assembly machine which can be readily and economically manufactured.

The means for accomplishing these and other objects and advantages of the present invention will become apparent to those skilled in the art from the following detailed description taken with reference to the accompanying drawings.

DETAILED DESCRIPTION OF THE INVENTION

Figure 1:
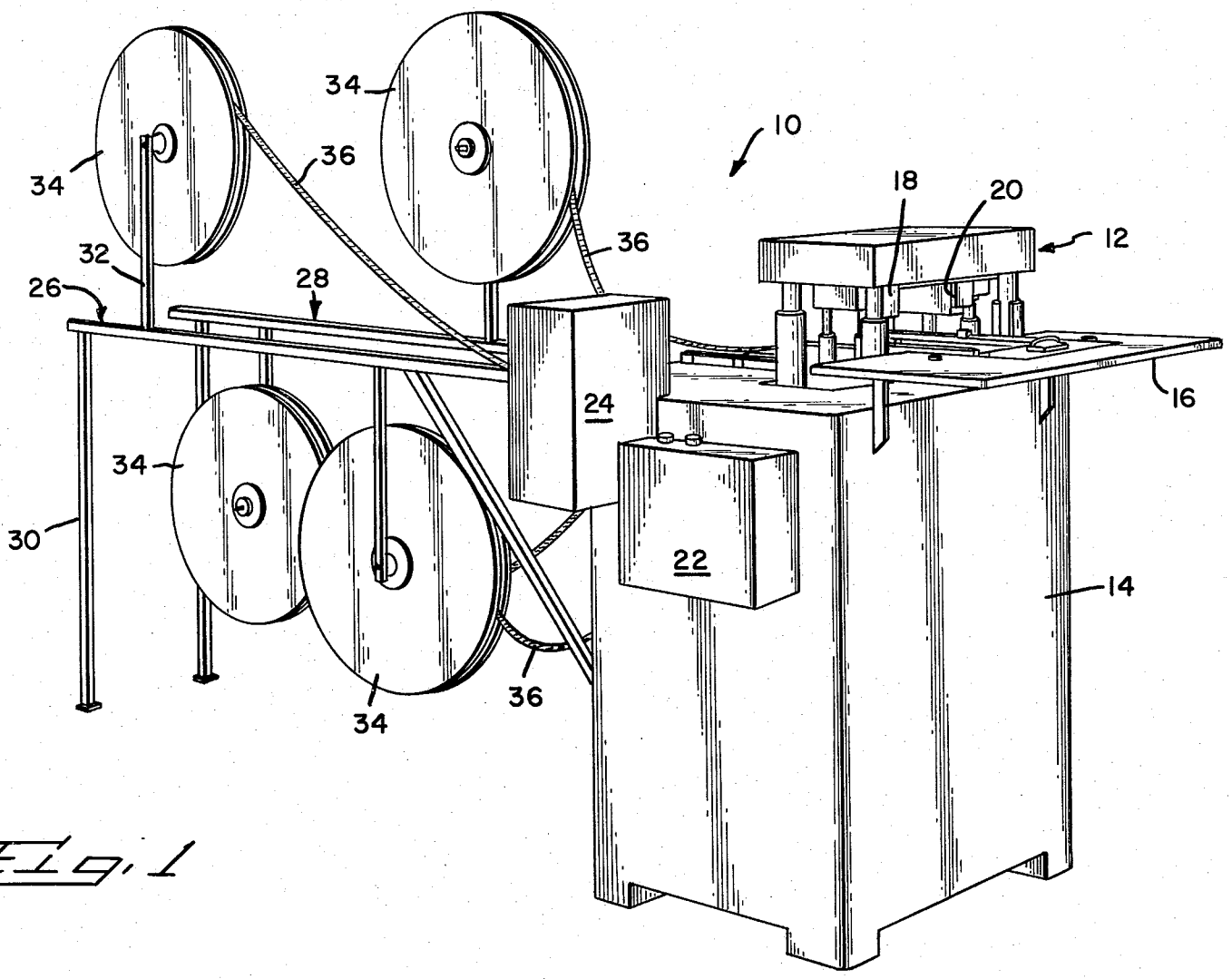
FIG. 1 is a perspective view of an entire cable harness assembly apparatus according to the present invention.

The subject assembly apparatus 10 is shown in its entirety in FIG. 1 and includes a press assembly 12 mounted on a base 14 which contains a known press drive means (not shown). A substantially horizontal work table 16 is mounted on the base directed toward the press. At least one terminal applicator 18, 20 is mounted so as to be accessible from the work table and actuated by the press. Electrical and fluid control means for the press are schematically represented by boxes 22, 24, respectively.

A terminal supply assembly 26, 28 for each applicator 18, 20, respectively, extends to the rear of the apparatus 10. Each terminal supply assembly includes a reel support frame 30 one end of which is attached to base 14 by screw adjustment means (not shown) so that the frame can be moved sideways to maintain alignment with the respective applicator as the latter is moved as required for terminating cables of different lengths. Each terminal supply assembly 26, 28 has means 32 to support a reel 34 of terminals 36 in continuous strip form. Each terminal supply assembly can further include terminal separator tape takeup means (not shown) and terminal strip detector and guide means (also not shown).

Each terminal supply assembly has been shown with two reels each feeding a strip of terminals. This is a stacked carrier strip arrangement as described in U.S. Pat. No. 4,021,095 and is used to supply overlapping strips of terminals to have terminals on a closer center line spacing than is possible with a single strip of terminals.

Figure 2:
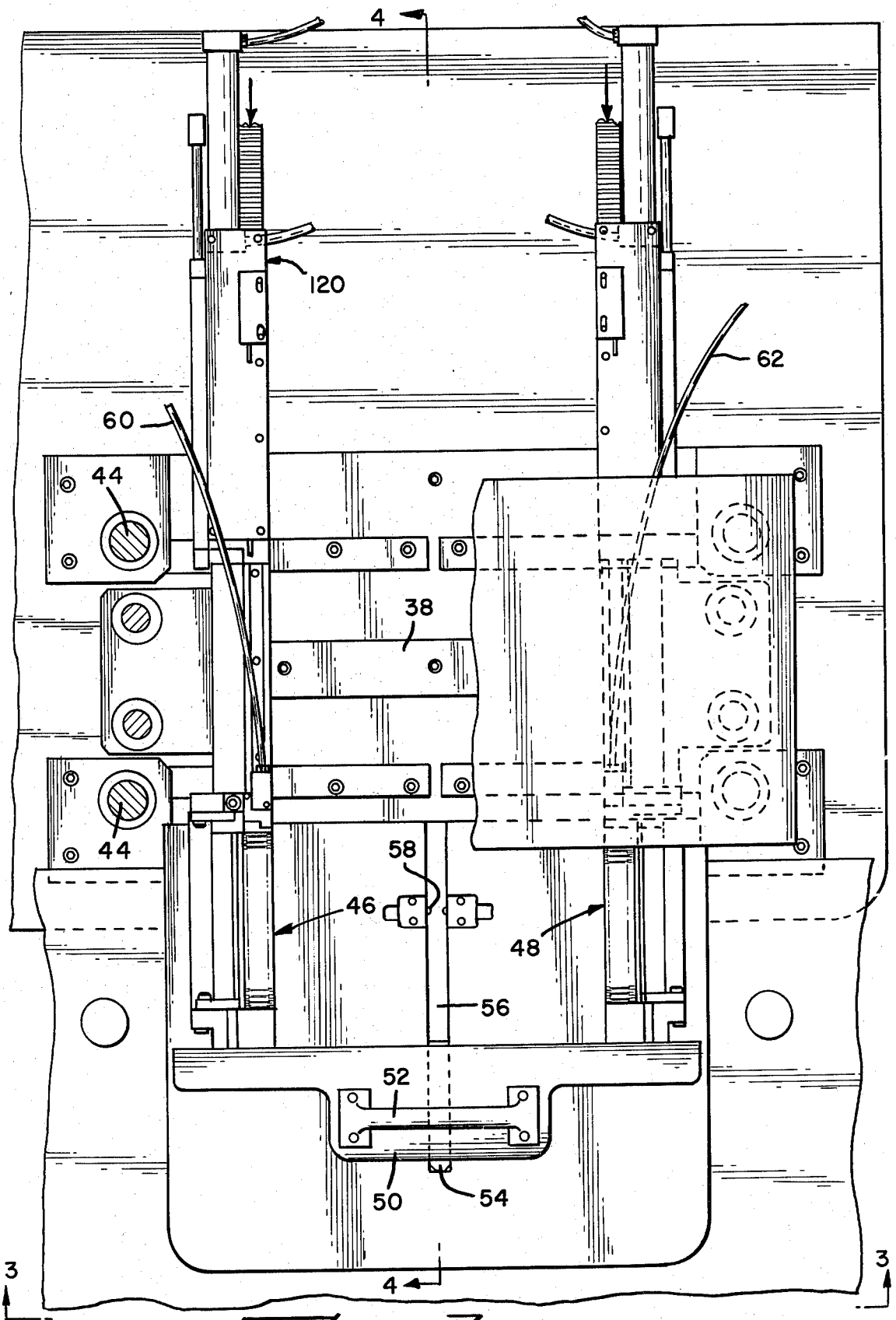
FIG. 2 is a top plan view, partially in section, of the cable harness assembly apparatus of FIG. 1.
Figure 3:
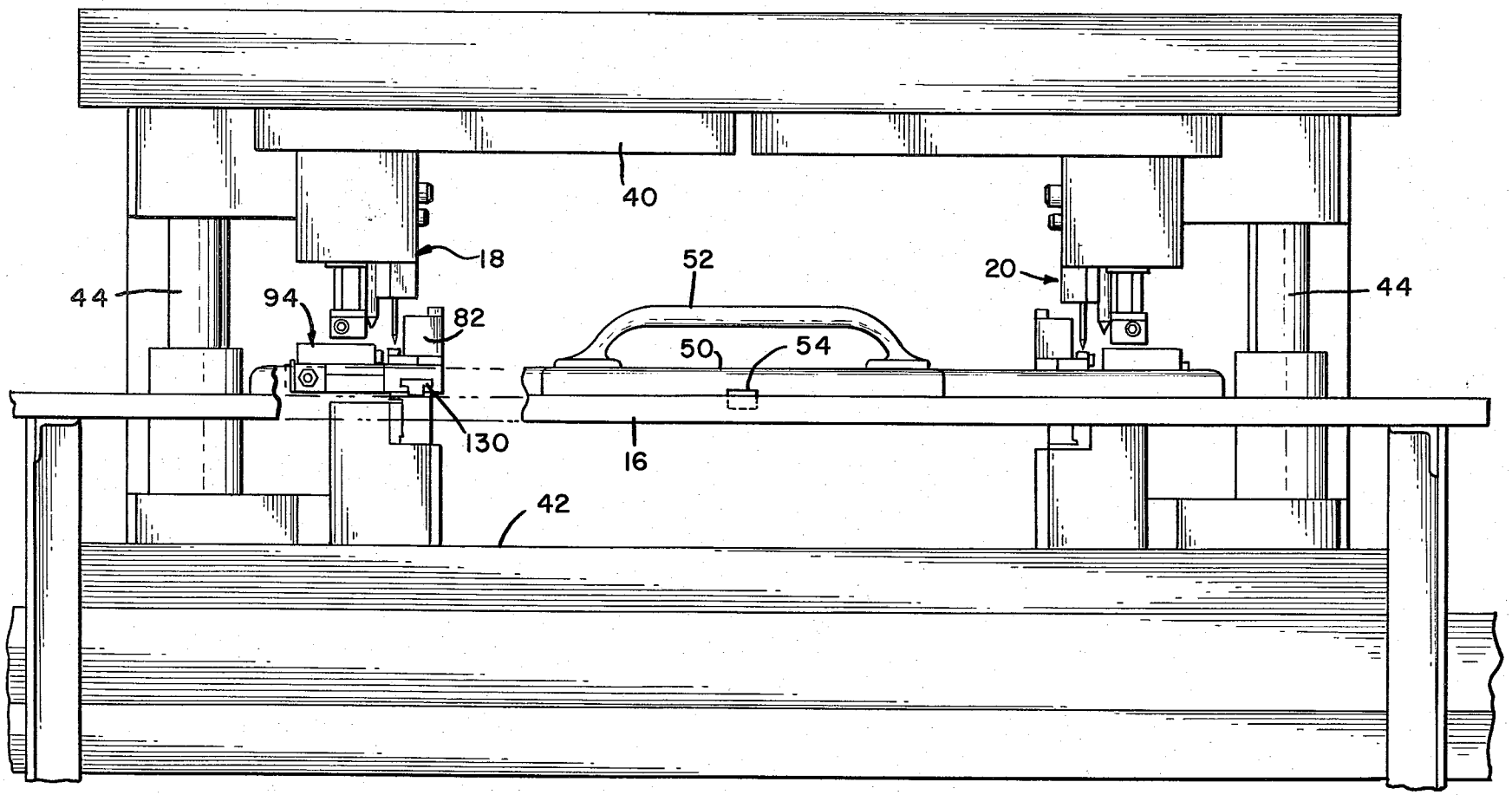
FIG. 3 is a front elevation, partially broken away, of the cable harness assembly apparatus of FIG. 1.
Figure 4:
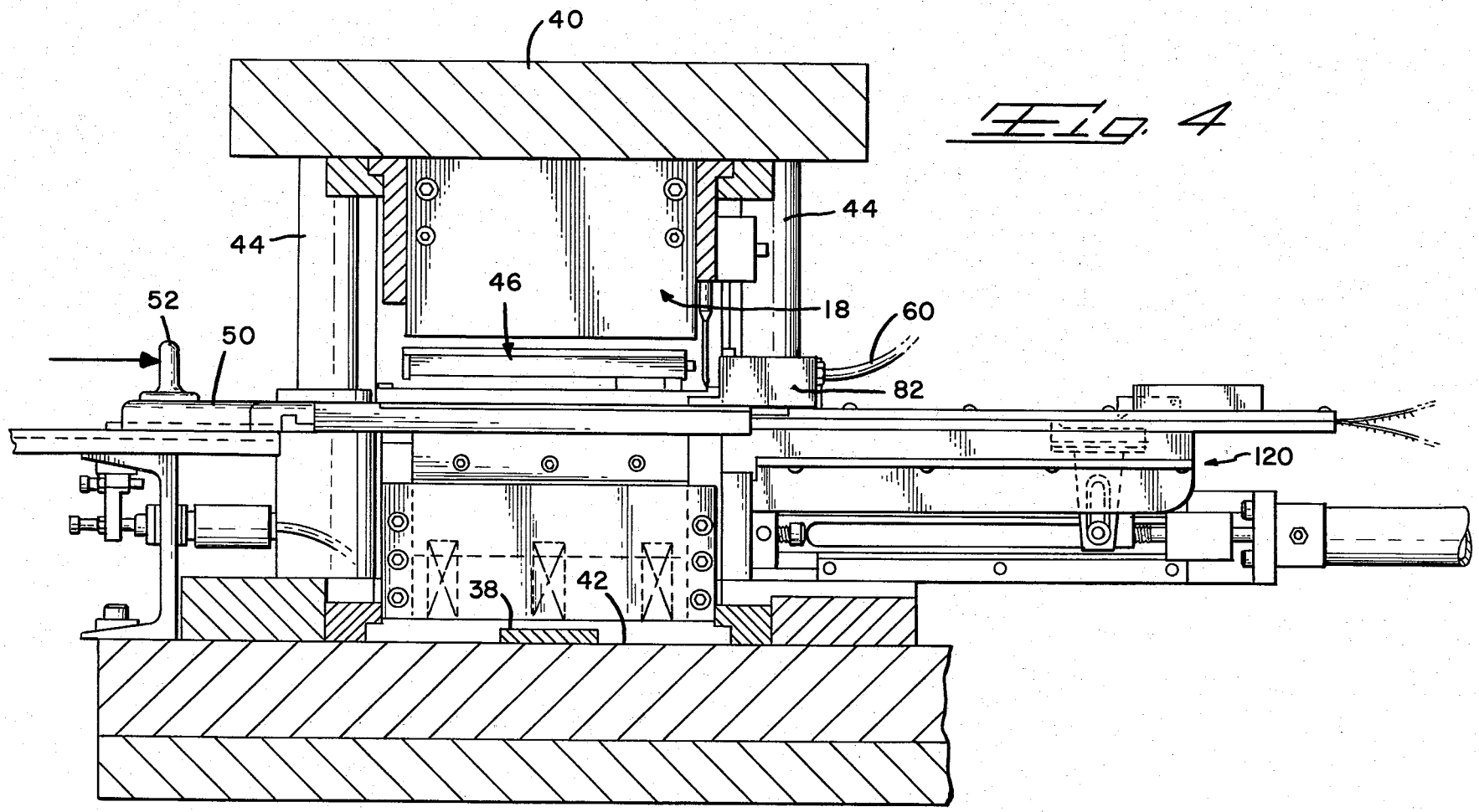
FIG. 4 is a vertical section, taken along line 4—4 of FIG. 2.
Figure 5:
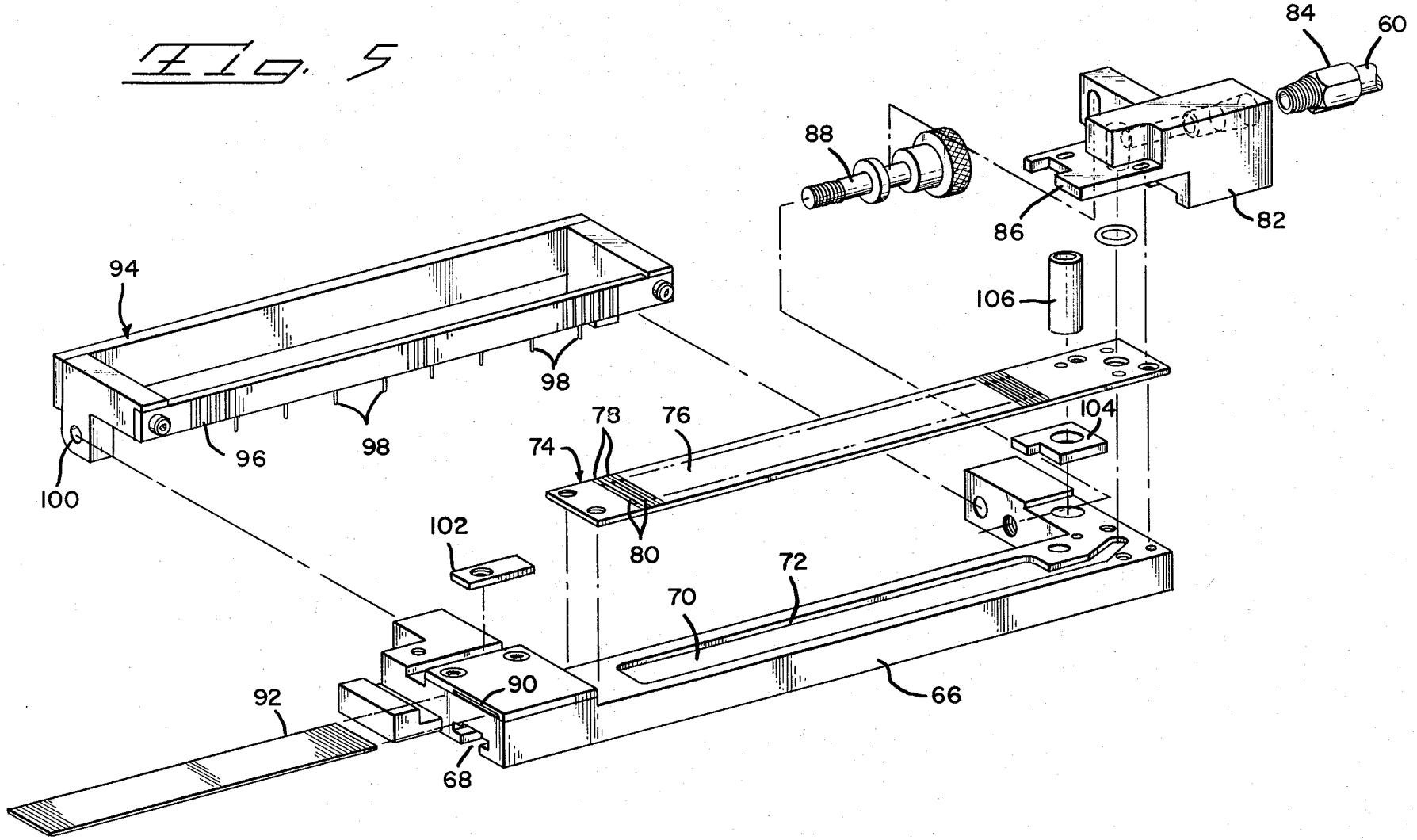
FIG. 5 is an exploded perspective view of a cable hold down assembly according to the present invention.

Turning now to FIGS. 2 to 4 the subject machine is shown with left and right spaced applicators 18, 20 mounted on a single transverse guide rail 38 so that they can be moved relative to each other between the upper and lower plates 40, 42 of the press, which are connected by posts 44. Each applicator 18, 20 is connected to a respective terminal supply assembly 26, 28, as mentioned previously. The relative positioning of the applicators is controlled by a drive means (not shown) which will keep the applicators symmetrical with respect to the press.

A cable hold down assemblies 46, 48 is provided for each applicator 18, 20, respectively. A tie bar 50, having a handle 52, interconnects the hold down assemblies 46, 48 and has a projection 54 which is slidable along a guide groove 56 in the work table 16 between a loading position (FIG. 2) and a crimping position aligned with the respective applicators (FIG. 4) by detent means 58. Each cable hold down assembly 46, 48 is attached to a vacuum source (not shown) by means of flexible conduits 60, 62, respectively.

The left hand cable hold down assembly 46 is shown in FIGS. 5 to 8 and includes an elongated member 66 having a guide slot 68 in the base thereof and an elongated central chamber 70 with an upwardly directed opening 72. A plate 74 is detachably secured to the top of the member 66 and has an upwardly directed profiled surface 76 including a plurality of parallel spaced grooves 78 each with a centrally disposed slot 80 leading to the chamber 70. The plate 74 can be replaced by a similar plate having grooves and slots on different center line spacings. A manifold means 82, to which the source of vacuum is attached by coupling 84 and conduit 60, is adjustably attached to one end of member 66 with end surface 86 forming a cable edge guide. An adjustment screw 88 engages in member 66 and with manifold means 82 to control the relative positioning thereof and also the positioning of cable edge guide 86 with respect to the profiled surface 76 of plate 74. At the opposite end of the member 66 there is transverse slot 90 through which movable strip means 92 is selectively extended to lie against the profiled surface 76 of the plate 74 to close off a selected number of slots 80 thereby compensating for the width of cable to be secured by the hold down assembly 46. The strip means 92 preferably has a profiled bottom surface that corresponds to the profiled top surface 76 of plate 64. The hold down assembly 46 further includes a cable end stop member 94 having a profiled front surface 96 and a plurality of spaced, downwardly directed standoff pin means 98. This stop member 94 is pivotally attached to member 66 by pins 100 and is arranged to lie immediately adjacent the slotted plate 74 on stop blocks 102, 104 and serve as a cable end abutment. At one end of the vacuum chamber member 66 there is a fixed, vertically directed alignment cylinder 106.

Figure 6:
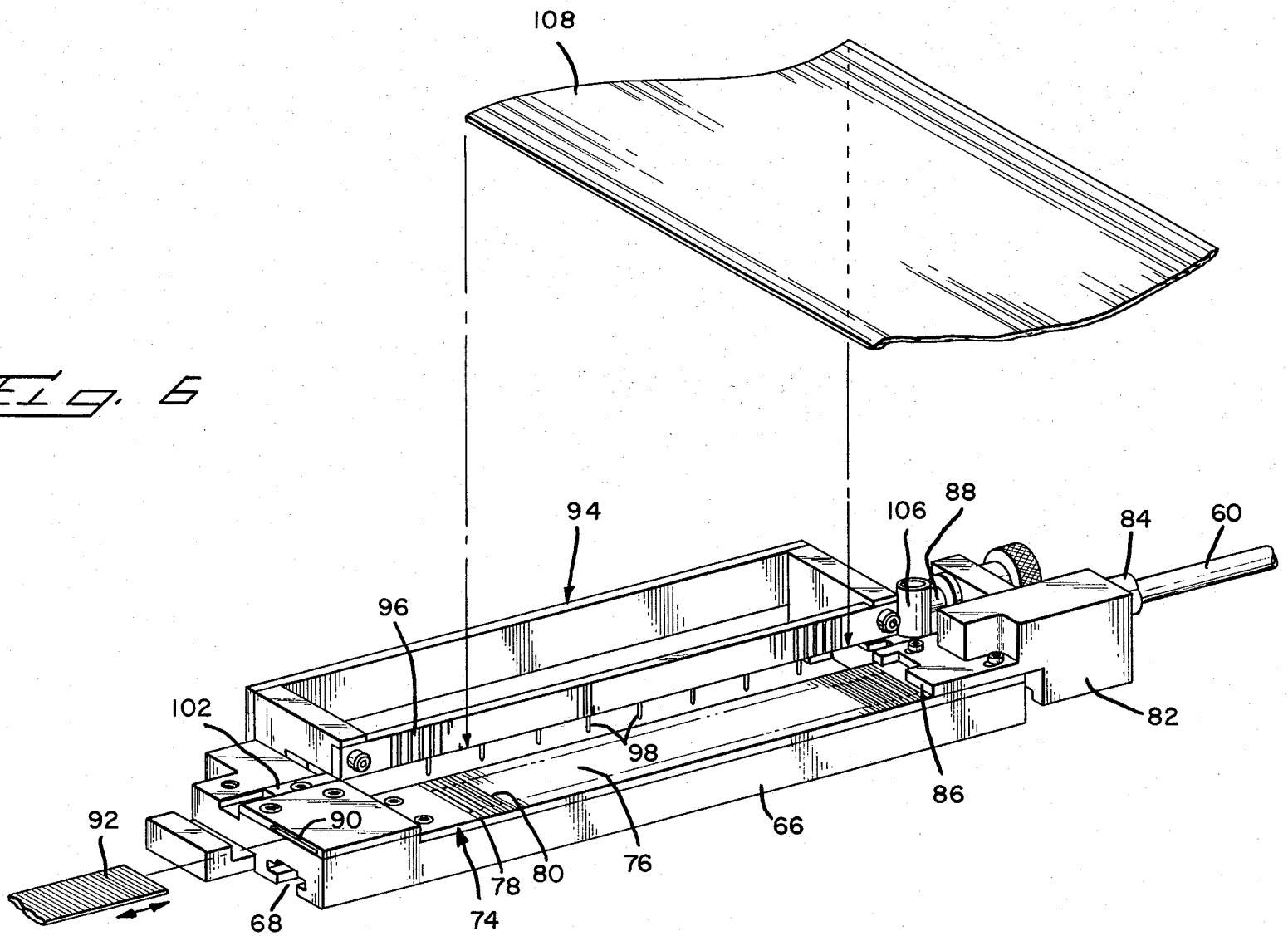
FIG. 6 is a perspective view of the cable hold down assembly according to the present invention with a cable exploded therefrom.
Figure 7:
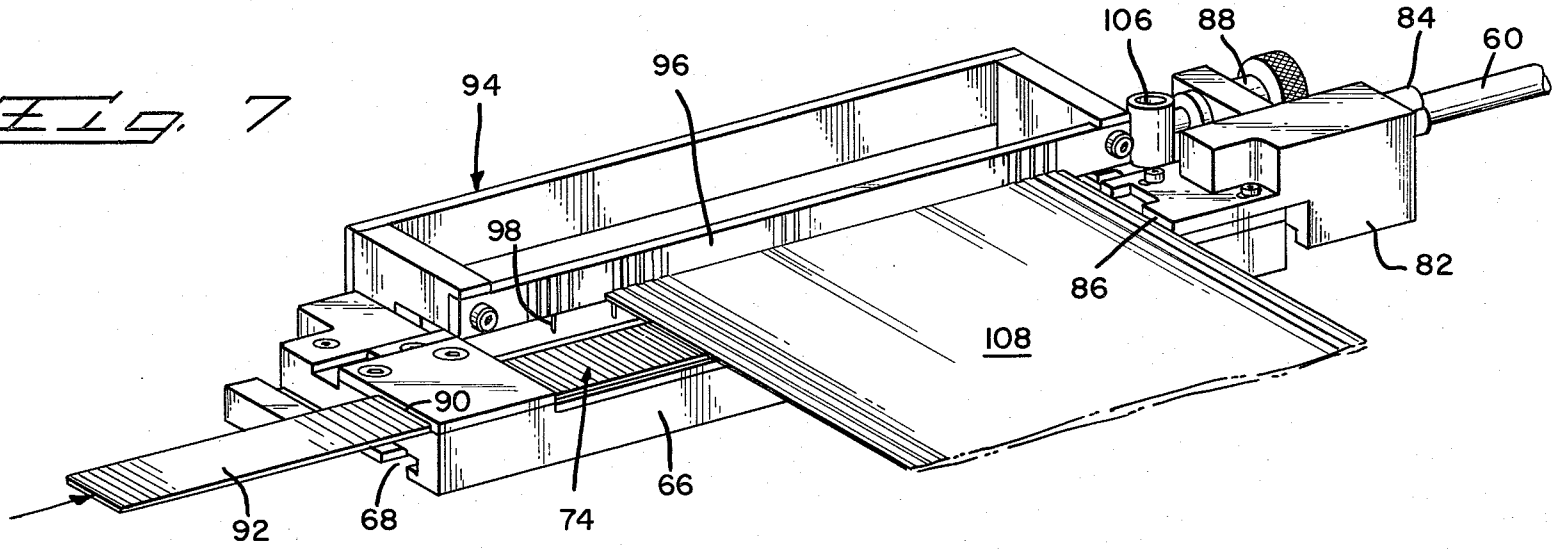
FIG. 7 is a perspective view, similar to FIG. 6, showing a cable properly located and held in position by the subject cable hold down assembly.
Figure 8:
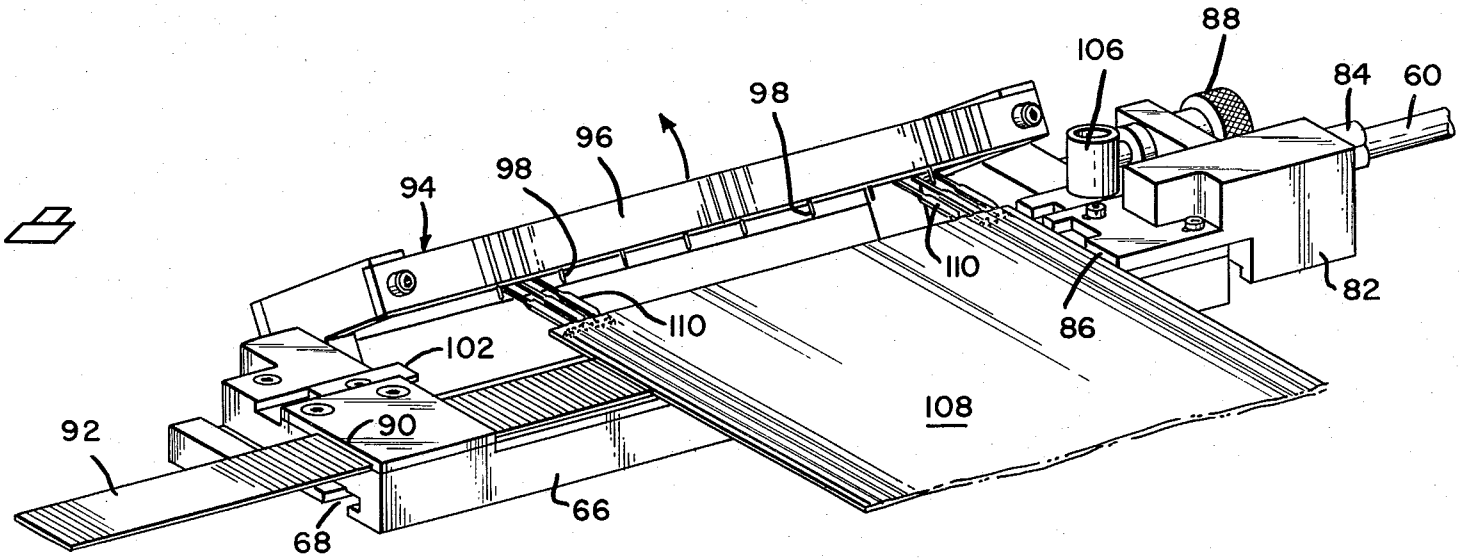
FIG. 8 is a perspective view similar to FIGS. 6 and 7 showing, the hold down assembly actuated to release a terminated cable.

The operation of the cable hold down means is shown in FIGS. 6, 7, and 8 with a cable 108 being shown spaced above the hold down assembly in FIG. 6. In FIG. 7 the cable 108 has been applied against profiled face 96, edge guide 86, the slotted plate 74, with the vacuum in chamber 70 holding the cable tightly in place with each conductor being held in a respective recess 78 in the profiled plate 74. One lateral edge of the cable is against the adjustable abutment 86 while the forward free edge is against the front face 96 of the pivotable stop member 94. The control strip 92 for the vacuum hold down assembly has been applied to the surface of plate 74 to adjust for the width of the cable.

FIG. 8 shows the cable after it has been terminated by crimping a terminal 110 onto each conductor (not shown). It will be appreciated from this figure that since the terminals project from the end of the cable which abuts face 96, it is necessary for the cable end stop member 94 to be swung upwardly to free the terminals. This movement can be arranged to cause the vacuum to be cut off so that the terminated cable 108 is released from the hold down assembly thereby allowing the completed cable harness to be removed from the machine.

Figure 9:
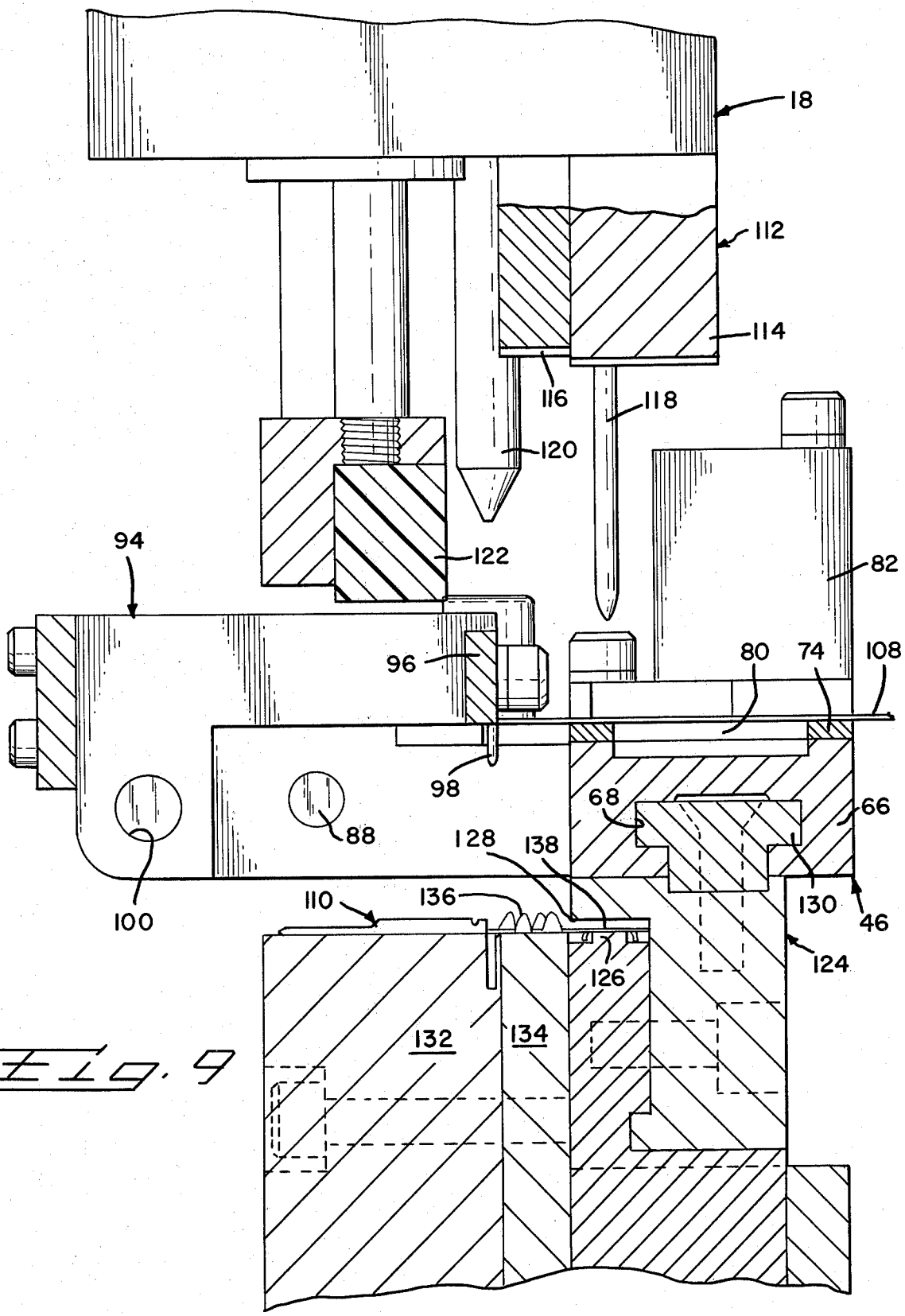
FIG. 9 is a transverse vertical section through an applicator of the cable harness assembly apparatus of FIG. 1 with the applicator positioned ready to apply terminals to a cable.
Figure 10:
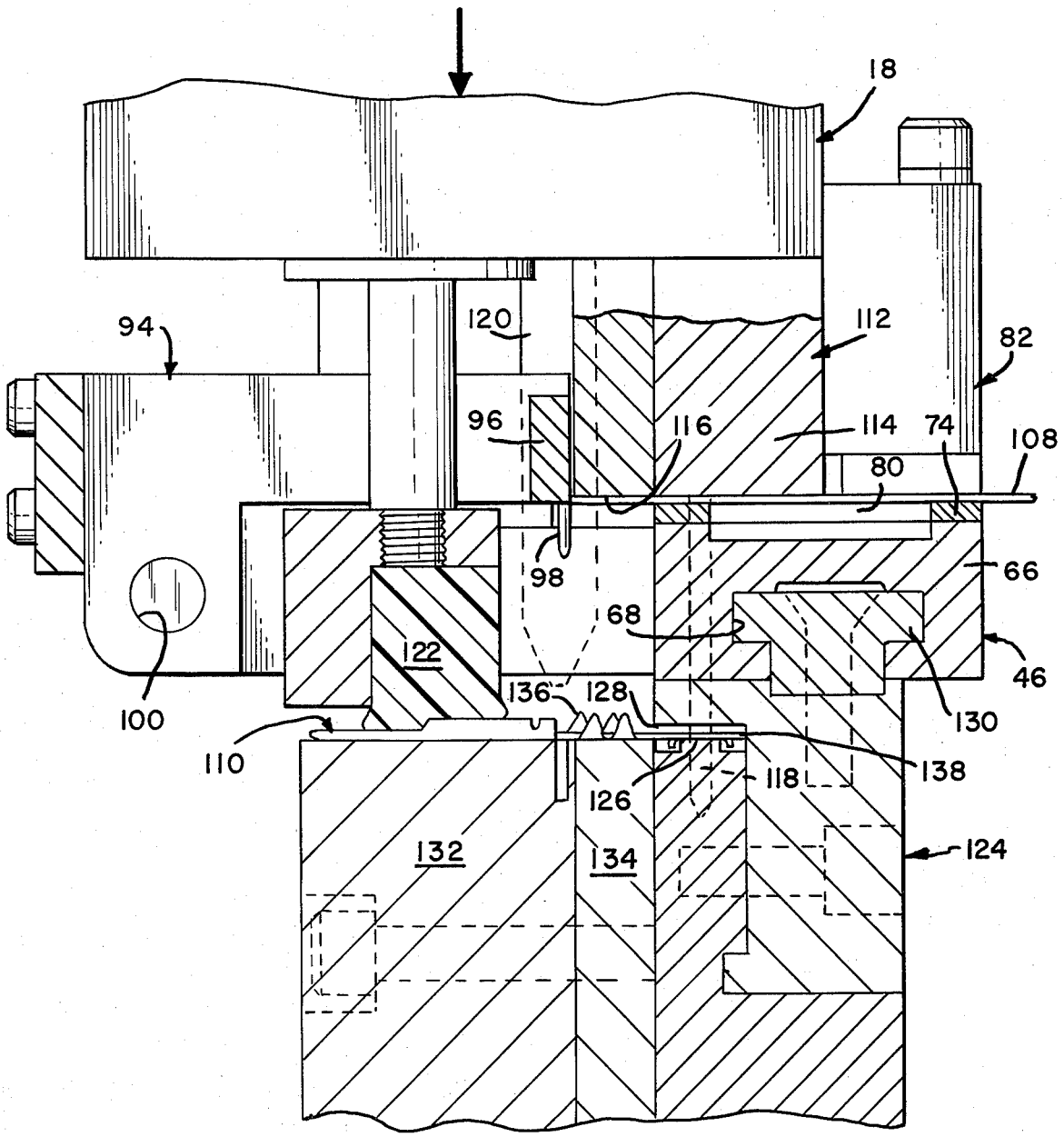
FIG. 10 is a section view similar to FIG. 9 showing the applicator at the point of shearing the terminals from their carrier strips.
Figure 11:
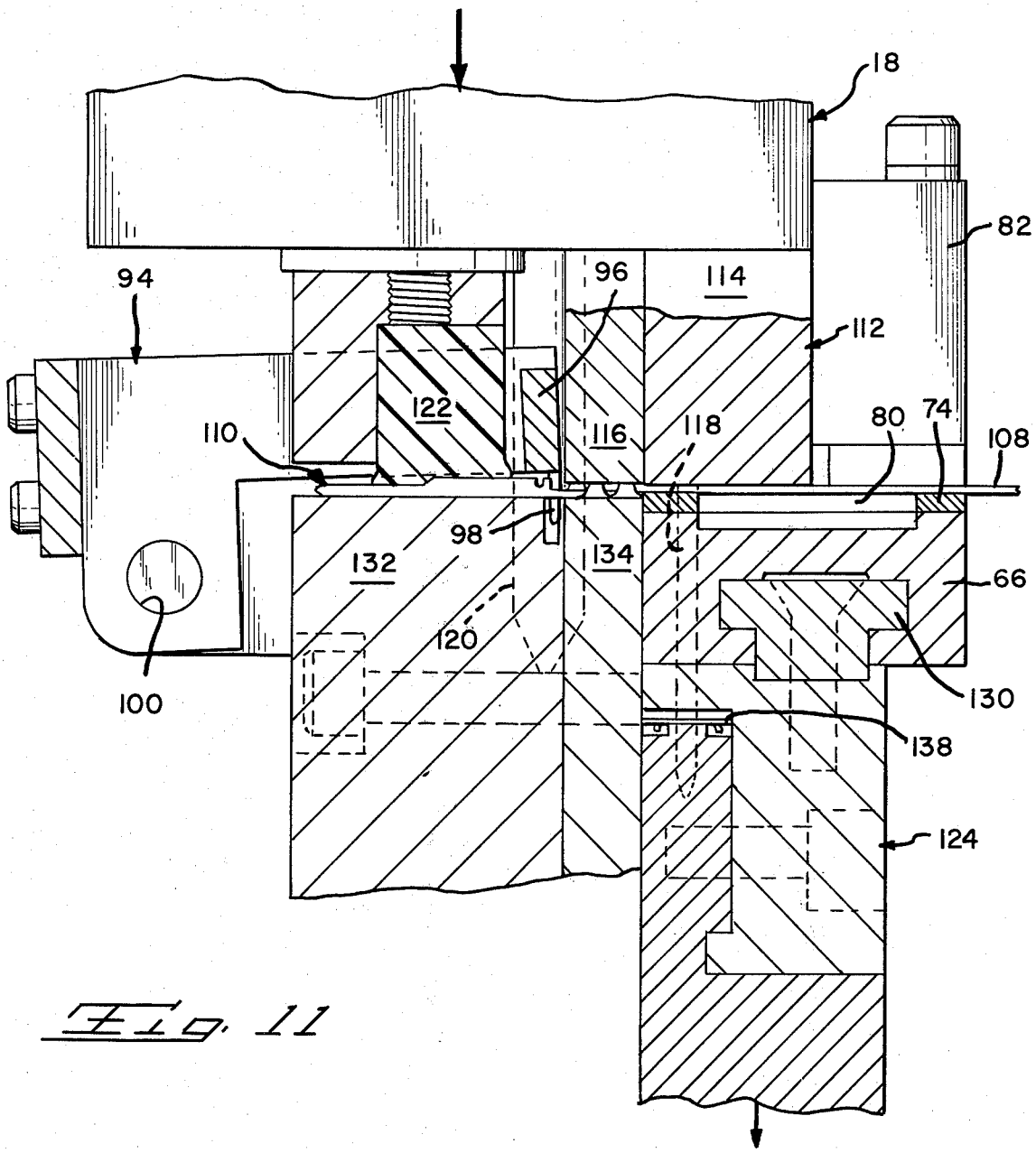
FIG. 11 is a section view similar to FIGS. 9 and 10 showing the applicator in a terminal crimping condition.

FIGS. 9, 10, and 11 show the details of the termination operation performed by the applicator portion of the machine. In FIG. 9 the applicator 18 is in the ready condition with the upper sub assembly 112 formed by cable gripping member 114, crimp member 116, terminal guide pin 118, hold down guide pin 120 and terminal hold down member 122 in a raised condition. The intermediate sub assembly 124 formed by carrier strip support and guide member 126, shear member 128, and guide rail 130 with hold down assembly 46 positioned thereon, is in a raised condition due to the action of the springs schematically shown in FIG. 4. The terminal support member 132 and anvil 134 are in their fixed position. A single strip of terminals 112 is shown passing over support member 132 with the crimp portion 136 on anvil 134 and the carrier strip 138 on guide 126 beneath shear member 126. The hold down assembly 46 has been actuated to position the cable 108 in the applicator.

Figure 12:
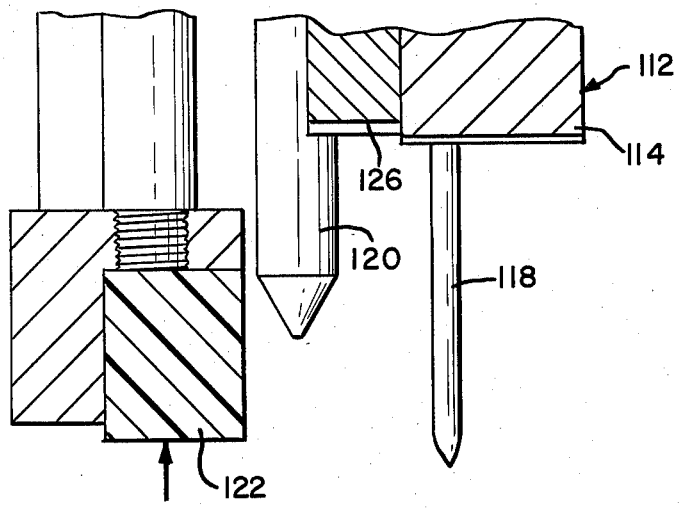
FIG. 12 is a section view similar to FIGS. 9 to 11 showing the applicator after termination of the cable but before release of the cable by the hold down assembly.
Figure 12:
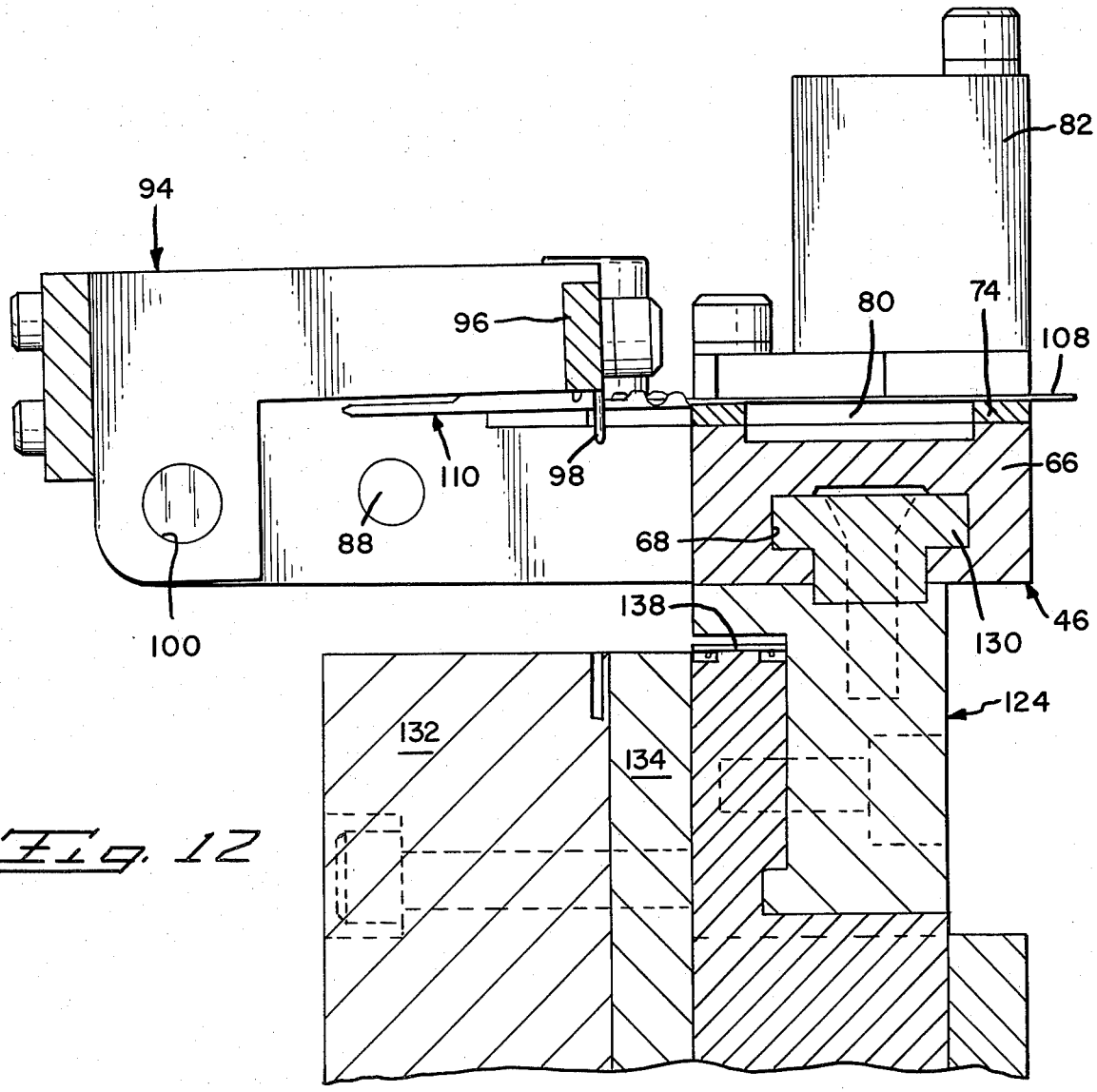

When the press is actuated (see FIG. 10) the upper and intermediate applicator sub assemblies 112, 124, respectively, are brought together. First the guide pin 118 engages in alignment holes (not shown) in the carrier strip 138 to center the terminals in the applicator. Next the guide pin 120 engages the sleeve 106 of the hold down assembly 46 to insure proper positioning of it with respect to the terminals 112. The gripping member 114 makes contact with the cable 108 and the terminal hold down member 122 makes contact with the terminals 112. Continued actuation of the press brings the upper and intermediate sub assemblies to the condition of FIG. 11. First the terminals 112 are sheared from the carrier strip 138 and then the insulation piercing tines of the crimp barrel 136 are driven into the cable 108 where the crimp member 116 crimps them into engagement with the conductors. This movement also causes a slight rocking of the cable end stop member 94. When the crimping is completed, FIG. 12, the press is withdrawn freeing both the cable hold down assembly 46 and the carrier strip 138 so that the terminated cable can be removed from the machine and the terminal strip fed forwardly to position further terminals at the work station. Feed of the terminal strip is accomplished by the known terminal feed assembly 140, shown in FIG. 4.

The present invention may be subject to many modifications and changes without departing from the spirit or essential characteristics thereof. The present embodiment should therefore be considered in all respects as illustrative and not restrictive of the scope of the invention.

What is claimed is:

1. A machine for the manufacture of electrical cable harnesses by gang crimping terminals to one or both ends of multi-conductor flat flexible cable in a single operation, said machine comprising:

a press assembly defining a work station;

at least one multi-terminal applicator mounted in said work station so as to be actuated by said press;

means to feed a continuous supply of terminals in strip form to each said at least one multi-terminal applicator; and a cable hold down assembly for each said at least one multi-terminal applicator, said cable hold down assembly being mounted for reciprocal movement into and out of said applicator and comprising a vacuum hold down member, an edge guide adjustably mounted on said member, and an end abutment pivotally mounted on said member.

2. A machine according to claim 1 said vacuum member of said cable hold down assembly comprises:

an elongated member defining a chamber therein;

at least one upwardly directed aperture opening into said chamber; and assembly guide means extending along the bottom of said member.

3. A machine according to claim 2 wherein said cable hold down assembly further comprises:

a plate detachably mounted on said vacuum member covering said at least one upwardly directed aperture, said plate having a profiled upper surface including a plurality of parallel grooves spaced apart a distance equal to the spacing of conductors in the cable, and a slot in each groove opening into said chamber of said vacuum member.

4. A machine according to claim 3 wherein said cable hold down assembly further comprises:

means compensating for cables of different widths, said means comprising a flexible member with a profiled surface mating with the surface of said plate and selectively applied thereto according to the width of cable to be terminated.

5. A machine according to claim 2 wherein said cable hold down assembly further comprises:

a manifold member adjustably mounted on said vacuum member, said manifold member having a through passage one end of which receives means connecting said assembly to said vacuum source and the other end of which opens on said chamber of said vacuum member, an end surface of said manifold member defining said cable side edge locating means.

6. A machine according to claim 2 wherein said cable hold down assembly further comprises:

a rectangular frame pivotally attached to said vacuum member with a common elongated axis, one elongated side of said frame including downwardly directed standoff pins and an outwardly directed profiled surface defining a cable end abutment.

7. A machine according to claim 2 wherein said cable hold down assembly further comprises:

guide means cooperating with a respective said at least one applicator to assure proper relative alignment thereof.

8. A machine according to claim 1 further comprising:

bar means interconnecting each said cable hold down assembly for the unitary movement thereof.

9. A machine according to claim 1 wherein each said at least one multi-terminal applicator comprises:

means supporting a plurality of terminals at a work station including an anvil beneath crimp barrel portions of said terminals;

means to assure alignment of said terminals in said applicator;

means for gripping said terminals;

means for backing up said cable during crimping;

means for aligning said cable hold down assembly with respect to said applicator;

means for shearing said terminals from their carrier strip; and striker means to effect crimping of said terminals onto respective conductors of said cable.

10. A machine according to claim 1 for simultaneous termination of both ends of a flat flexible cable comprising:

a pair of applicators mounted in said work station each connected to a respective supply of terminals and having a respective cable hold down assembly, and means for moving said applicators, supply of terminals and hold down assemblies with respect to each other in such fashion as to remain symmetrical with respect to said press assembly.

11. A cable hold down assembly for accurately positioning and securing a multi-conductor flat flexible cable in a work station during gang crimping of terminals to respective conductors of said cable, said assembly comprising:

an elongated vacuum member defining a chamber therein connected to a vacuum source, at least one upwardly directed aperture opening into said chamber, a plate detachably mounted on said vacuum member covering said at least one upwardly directed aperture, said plate having a profiled upper surface including a plurality of parallel grooves spaced apart a distance equal to the spacing of conductors in the cable, and a slot in each groove opening into said chamber of said vacuum member, assembly guide means extending along the bottom of said vacuum member, a cable side edge locating means adjustably mounted on said vacuum member; and a cable end abutment means pivotally mounted on said vacuum member.

12. A cable hold down assembly according to claim 11 further comprising:

means compensating for cables of different widths, said means comprising a flexible member with a profiled surface mating with the surface of said plate and selectively applied thereto according to the width of cable to be terminated.

13. A cable hold down assembly according to claim 11 further comprising:

a manifold member adjustably mounted on said vacuum member, said manifold member having a through passage one end of which receives means connecting said assembly to said vacuum source and the other end of which opens on said chamber of said vacuum member, an end surface of said manifold member defining said cable side edge locating means.

14. A cable hold down assembly according to claim 11 wherein said cable end abutment means comprises:

a rectangular frame pivotally attached to said vacuum member with a common elongated axis, one elongated side of said frame including downwardly directed standoff pins and an outwardly directed profiled surface defining a cable end abutment.

* * * * *